US009188406B2

(12) United States Patent
DenBleyker

(10) Patent No.: US 9,188,406 B2
(45) Date of Patent: Nov. 17, 2015

(54) HAND GUN SHOULDER-SUPPORTED SHOOTING PLATFORM

(71) Applicant: GoTo Skelton Stocks, LLC, Hamilton, MI (US)

(72) Inventor: Thomas L. DenBleyker, Hamilton, MI (US)

(73) Assignee: GOTO SKELETON STOCKS LLC, Hamilton, MI (US)

( * ) Notice: Subject to any disclaimer, the term of this patent is extended or adjusted under 35 U.S.C. 154(b) by 0 days.

(21) Appl. No.: 14/460,486

(22) Filed: Aug. 15, 2014

(65) Prior Publication Data

US 2015/0068097 A1 Mar. 12, 2015

Related U.S. Application Data

(60) Provisional application No. 61/875,188, filed on Sep. 9, 2013.

(51) Int. Cl.
*F41C 23/12* (2006.01)

(52) U.S. Cl.
CPC ..... *F41C 23/12* (2013.01)

(58) Field of Classification Search
CPC ..... F41C 23/00; F41C 23/04; F41C 23/10; F41C 23/12; F41C 23/14; F41C 23/20
USPC ..... 42/72, 71.02, 71.01, 73, 74
See application file for complete search history.

(56) References Cited

U.S. PATENT DOCUMENTS

| | | | | |
|---|---|---|---|---|
| 28,433 | A | | 5/1860 | Alsop |
| 517,555 | A | | 4/1894 | Reed |
| 570,145 | A | | 10/1896 | Pittavino |
| 815,609 | A | | 3/1906 | Martin |
| 914,675 | A | | 3/1909 | Renfors |
| 1,016,695 | A | * | 2/1912 | Kimmel ..... 42/72 |
| 1,477,445 | A | * | 12/1923 | Petritsch ..... 42/72 |
| 1,557,865 | A | | 10/1925 | Neel et al. |
| 1,877,016 | A | | 9/1932 | Muson |
| 3,609,902 | A | | 10/1971 | Casull |
| 3,740,886 | A | | 6/1973 | Canon |
| 3,798,818 | A | * | 3/1974 | Casull ..... 42/72 |
| 4,271,623 | A | * | 6/1981 | Beretta ..... 42/72 |
| 4,989,358 | A | | 2/1991 | Aronson et al. |
| 5,056,253 | A | | 10/1991 | Willumsen |
| 5,092,070 | A | | 3/1992 | Perkins |
| 5,528,846 | A | | 6/1996 | Baggett |
| D411,280 | S | | 6/1999 | Van Ek et al. |
| 5,924,233 | A | | 7/1999 | Strobel |
| 6,267,335 | B1 | | 7/2001 | Barrett |
| 8,205,374 | B2 | | 6/2012 | Lamm |
| 8,438,771 | B1 | | 5/2013 | Boone |
| 2002/0007579 | A1 | * | 1/2002 | Bubits ..... 42/72 |
| 2005/0262753 | A1 | | 12/2005 | Lahti |
| 2013/0167424 | A1 | | 7/2013 | Nail et al. |
| 2014/0053447 | A1 | * | 2/2014 | Singh ..... 42/71.02 |

* cited by examiner

*Primary Examiner* — Jonathan C Weber
(74) *Attorney, Agent, or Firm* — Price Heneveld LLP

(57) ABSTRACT

A handgun shoulder support platform includes a shoulder support stably supporting a handgun to a shooter's shoulder when shooting the handgun, thus providing greatly improved shot accuracy. The support is preferably made of an elongated strip of metal with a rear section shaped to engage the shooter's shoulder and a front section, and a grip-engaging bracket ("perch") on the front section shaped to matably engage a grip of the handgun. The bracket is vertically open and shaped to engage and stably support a grip of the handgun without the use of mechanical fasteners. Multiple removable brackets can be provided for receiving differently shaped handgun grips.

6 Claims, 4 Drawing Sheets

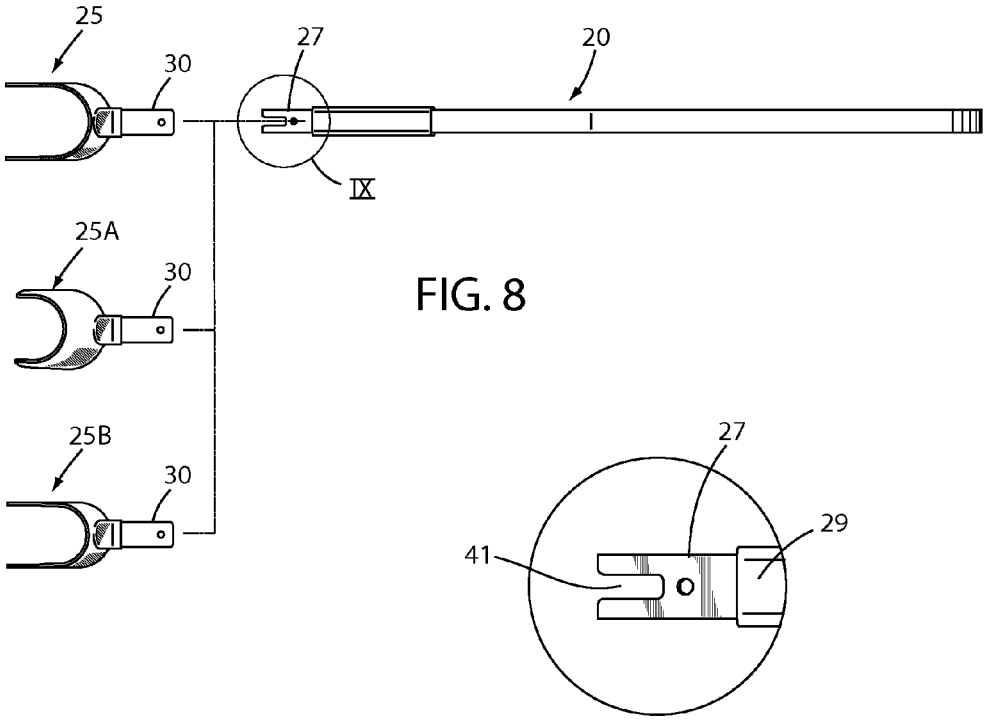
FIG. 8
FIG. 9
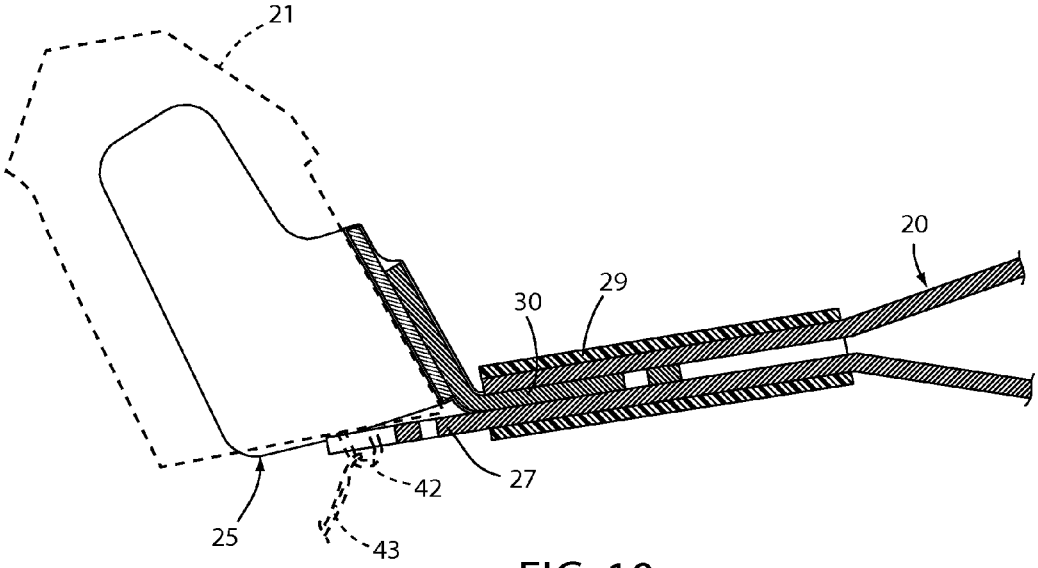
FIG. 10

HAND GUN SHOULDER-SUPPORTED SHOOTING PLATFORM

This application claims benefit under 35 USC §119(e) of provisional application Ser. No. 61/875,188 filed Sep. 9, 2013, entitled HAND GUN SHOULDER-SUPPORT, the entire contents of which are incorporated herein in its entirety.

BACKGROUND

The present invention relates to a handgun shoulder-supported shooting platform, and more particularly relates to a shoulder-supported platform that stabilizes a handgun for greatly improved shooting accuracy but that does so without fixed attachment of the handgun to the shoulder support.

It is known to attach stocks and extension devices to handguns so that the assembled units provide shooting accuracy approaching that of a long gun or rifle. However, most such stocks and extension devices include multiple components and are more costly and expensive than desired. Also, most such stocks and extension devices are uniquely customized to be fastened to a particular handgun grip, resulting in high inventory cost and low volume production runs. Also, most require modification of the handgun grip so that the devices can be fixed to the handgun grip, which many gun owners are hesitant to do. Also, many laws exist against having a short barrel gun with shoulder stock.

SUMMARY OF THE PRESENT INVENTION

In one aspect of the present invention, a handgun shoulder-supported platform is provided for stably supporting a handgun to a shooter's shoulder when shooting the handgun. The platform includes a shoulder-to-gun support (also called a "stock") made of at least one elongated strip of metal with a rear section shaped to engage the shooter's shoulder and having a front section, and a grip-engaging bracket (also called a "perch") on the front section shaped to matably engage a grip of the handgun while the shooter's hand holds the grip in the bracket.

In another aspect of the present invention, a handgun shoulder-supported platform for stably supporting a handgun to a shooter's shoulder when shooting the handgun, comprises a shoulder-to-gun support with a rear section shaped to engage a shooter's shoulder and with a front section having a grip-engaging bracket ("perch"), the bracket being vertically open and shaped to engage and stably support a grip of the handgun without the use of mechanical fasteners when the shooter's hand holds the gun grip to the bracket, the bracket characteristically not being fixedly attached to the grip.

In another aspect of the present invention, a handgun shoulder-supported platform for stably supporting a handgun to a shooter's shoulder when shooting the handgun, comprises a one-piece shoulder-to-gun support with a rear section shaped to engage a shooter's shoulder and a front section, and a U-shaped grip-engaging bracket ("perch") releasably attached to the front section and shaped to matably receive a grip of the handgun.

In another aspect of the present invention, a method of supporting a handgun to a shooter's shoulder for improved accuracy when shooting the handgun, comprises steps of providing a shoulder-to-gun support with a rear section shaped to engage a shooter's shoulder and a front section with a bracket ("perch") shaped to stably receive and support a grip of the handgun when clasped by hands of the shooter but with the bracket not being fixedly attached to the grip, supporting the handgun on the shoulder-to-gun support without fixed interconnection and while resting the support on a shooter's shoulder and while simultaneously clasping the grip and bracket with hands of the shooter, and shooting the handgun during the step of supporting.

These and other aspects, objects, and features of the present invention will be understood and appreciated by those skilled in the art upon studying the following specification, claims, and appended drawings.

BRIEF DESCRIPTION OF DRAWINGS

FIG. 8 is a top view of FIG. 4.

FIG. 9 is an enlarged view of the circled area (i.e. the bracket-engaging tab on the "perch-end" of the shoulder-to-gun support) in FIG. 8.

FIG. 10 is a cross section taken longitudinally thru and showing the bracket connection to the support in FIG. 3.

DETAILED DESCRIPTION OF PREFERRED EMBODIMENTS

Figure 1:
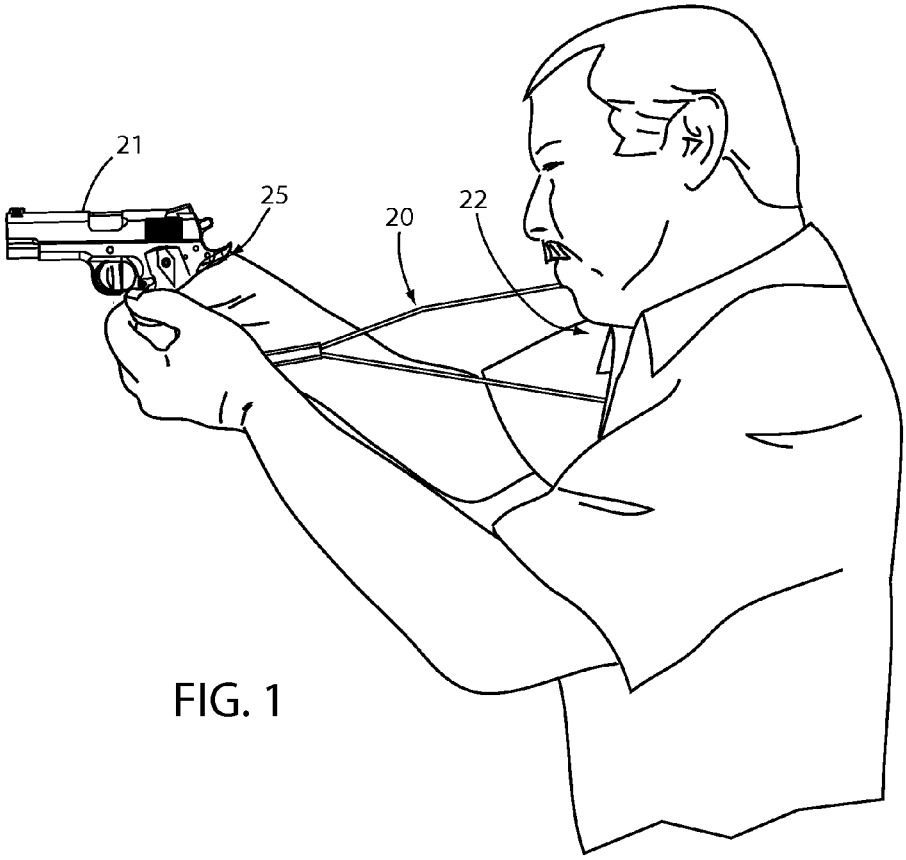
FIGS. 1-2 are perspective views of a handgun shoulder-supported platform, FIG. 1 showing a handgun supported by the present platform against a shooter's shoulder, FIG. 2 showing only the shoulder-supported platform and handgun (without the shooter).

The present apparatus comprises a shoulder-supported handgun shooting platform made of a shoulder support 20 and a gun-specific perch 25. The gun-stock-simulating shoulder-to-gun support 20 (FIG. 1, also called a "stock" herein) stably supports a handgun 21 on a shooter's shoulder 22 for accurate shooting, even without fixed attachment of the handgun to the perch 25. The resulting handgun-stabilized arrangement provides greatly improved shot accuracy approaching that of a long gun. The illustrated support 20 is made of a single elongated strip of metal with a rear section 23 (FIG. 2) shaped to stably engage the shooter's shoulder 22, and a front section 24 (FIGS. 2-4) shaped to stably removably engage the handgun-grip-engaging perch 25 (also called "bracket" herein). The bracket 25 includes a bayonet-like protruding tab 30 (FIG. 4) shaped to frictionally removably engage a socket receiver 29 (called "socket" herein) on a tail of the front section 24. The bracket 25 includes upright sidewalls, bottom wall, and rearward wall defining an upwardly-open pocket. The pocket that is vertically open but shaped to closely engage the grip of the handgun 21 so that, when firmly clasp by a shooter's hand, the handgun's grip 26 is stably supported inside the pocket of bracket 25 and becomes "one" with the support 20. Thus, the handgun 21 does not need to be secured by fasteners to fix the handgun to the platform. Notably, multiple brackets ("perches") can be provided for receiving differently shaped handgun grips (see FIG. 4, thus keeping costs down and reducing the need for a large inventory of customized gun-specific shooting platforms.

Figure 6:
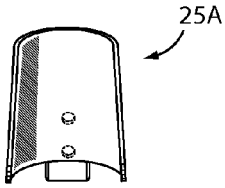
Figure 7:
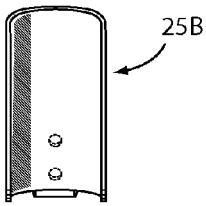

It is contemplated that the support 20 can be made of different metals and be made into different shapes. The illustrated support 20 is primarily made of a single strip of metal, such as an aluminum strip that is ⅛ inch×½ inch in cross section. The support 20 is about 16 inches long, with its rear section 23 being concavely shaped to fit comfortably and stably against the shooter's shoulder. The front section 24 (FIGS. 6-7) includes a horizontal lower tine 27 (and potentially an angled upper tine) secured to a socket 29. It is contemplated that the tine 27 can partially form the socket if desired, or only be an attachment site for a separate tube. The illustrated socket 29 is designed to frictionally receive the rearward bayonet-like tab 30 of the bracket 25. However, it is contemplated that the socket 29 can be formed by various means, such as by using a metal tube or strip of material. It is contemplated that a scope of the present invention also includes other ways to attach the bracket 25 to the support 20, such as by screws or other mechanical fasteners. Also, the scope of the present invention includes various shoulder-engaging shapes, cushioned and not cushioned.

Figure 5:
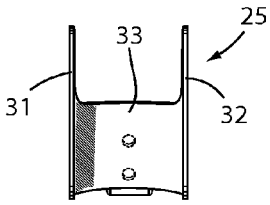
FIGS. 5-7 are end views of the three brackets in FIG. 4.

As noted, the illustrated bracket 25 includes walls 31-33 (FIG. 5) forming an upwardly-open C-shape or cup-shape (see FIG. 8) and includes the tab 30 for bayonet-like mating frictional attachment into the socket 29. A thinness of the walls 31-33 of the bracket 25 and a shape of the support 20 allows a shooter to clasp the grip 25 and the front section 24 as a unit, which greatly improved shooting accuracy, approaching that of a long gun. Further, when a shooter grips the handgun's grip and bracket 25 and draws the shooting platform against his/her shoulder, the resulting forces tend to cause the bracket 25 to more-securely engage the support 20, thus resulting in even greater stability. In the illustrated arrangement, the bracket 25 is welded or soldered to the tab 30, but it is contemplated that the bracket 25 could be attached by other means, such as by a pair of screws, rivets, brazing, solder, or even adhesives. Sides of the bracket 25 are shaped to closely support sides of the grip 25 when the grip and bracket are clasped by a shooter's hands, thus causing the grip and bracket to become a unit when clasp by the shooter's hands. (See FIG. 1.) My testing suggests that the present support 20 can improve shooting accuracy by 90%. Also, my testing suggests that while most shooters can shoot with a reasonable accuracy at 30 yards, the present support 20 can provide them with good shooting accuracy up to 60 yards or more, such as 80-100 yards.

Figure 2:
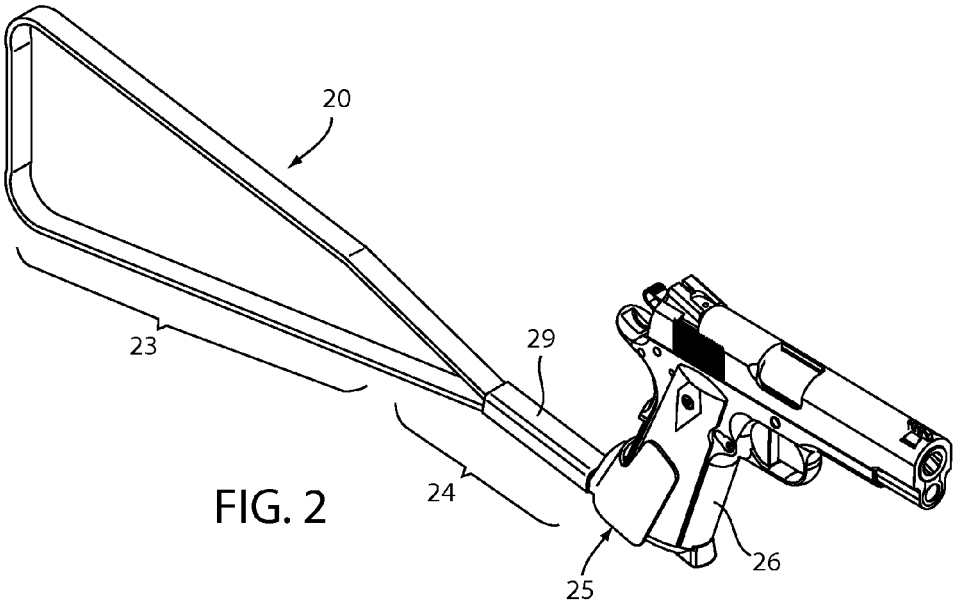
Figure 3:
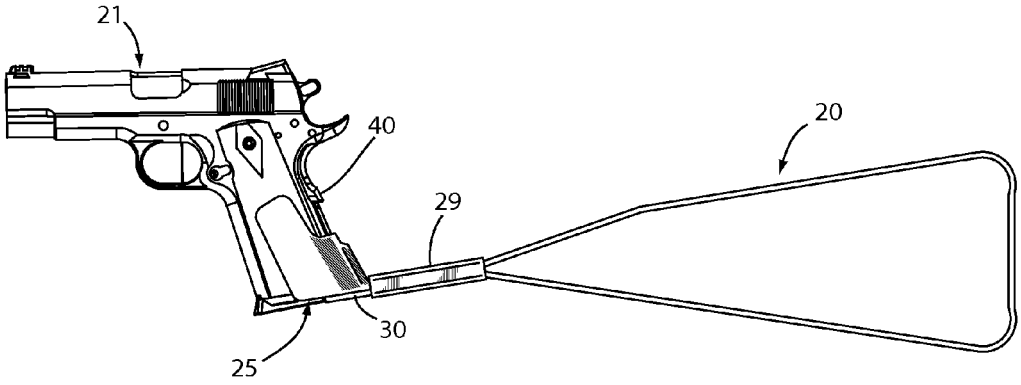
FIG. 3 is a side view of FIG. 2.
Figure 4:
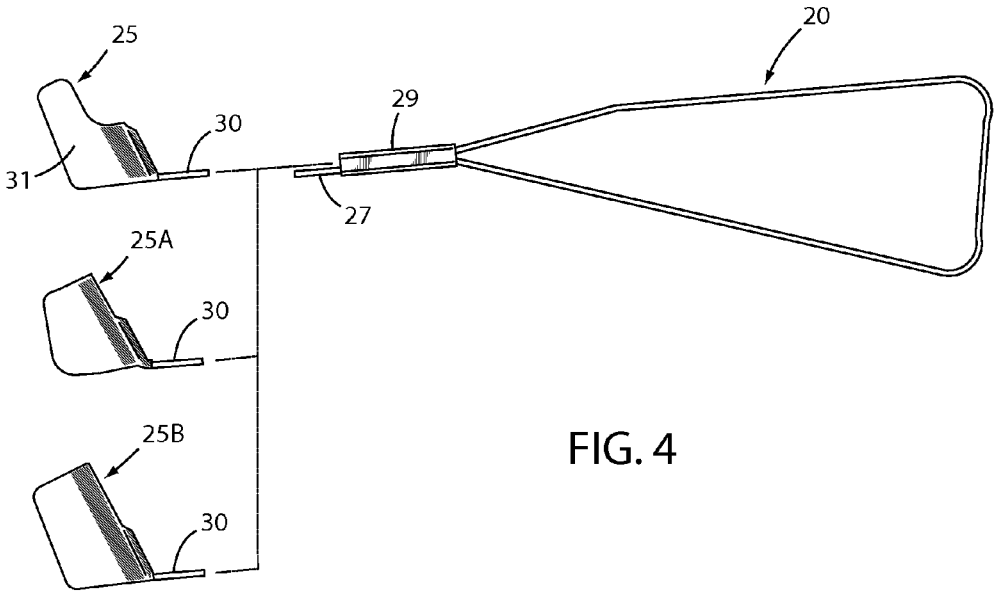
FIG. 4 is a side view of the handgun shoulder-supported platform in FIG. 3, the platform including a shoulder-to-gun support (also called a "stock") and three removable handgun-grip-engaging brackets (also called "perches")

FIGS. 1-2 are side views of a handgun supported by the present innovative handgun shoulder support against a shooter's shoulder, FIG. 1 showing the shooter close to taking a shot and generally showing hand and eye positions, and showing the relationship of the handgun and support 20 to the shooter's shoulder. FIGS. 3-8 show details of three different brackets 25-25B. The bracket 25 (FIGS. 4-5, 8) includes upwardly-extended sidewalls that extend above the fore-shortened rear wall (see FIG. 3) to define an opening for non-interferingly exposing a grip-supported palm safety 40 on the handgun 21. Also, the bottom wall on the bracket 25 is fore-shortened and the tab 30 includes an open-ended slot 41 (FIG. 9) shaped to non-interferingly receive a downwardly-extending loop 42 on the handgun's grip. This allows a lanyard/cord 43 to be connected between the loop and a shooter, so that the handgun is not lost even if accidentally dropped by the shooter. The brackets 25A (FIGS. 4,6,8) and 25B (FIGS. 4,7,8) show that the walls of the brackets can be changed to accommodate different handgrip shapes.

Figure 11:
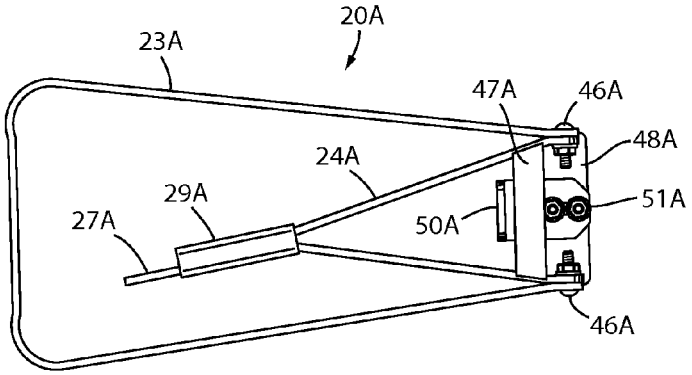
FIGS. 11-13 are side views of a modified shoulder-to-gun support, and showing the support foldable between a collapsed position (FIG. 11), an unlocked open position (FIG. 12), and a locked open position (FIG. 13).
Figure 12:
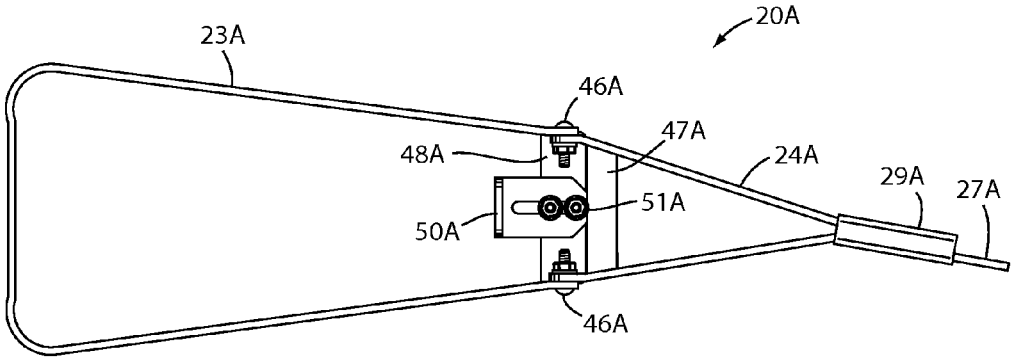
Figure 13:
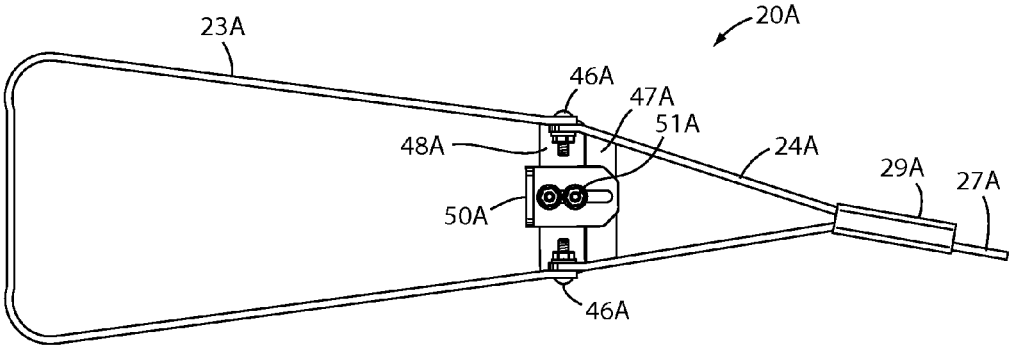

FIGS. 11-13 are side views of an alternative handgun shoulder support 20A. Similar and identical components are identified using similar numbers but with a letter "A". The illustrated support 20A includes front and rear sections 24A and 23A made of strip metal and pivoted together at a hinge formed by top and bottom vertical bolts 46A. The support 20A also includes a tine 27A (i.e. releasable connector) and tab-receiving socket 29A. Vertical strips 47A and 48A on front and rear sections 24A and 23A maintain a shape of the sections 23A-24A so that they do not collapse and undesirably bend the area around hinge bolts 46A. The strip 48A also supports a plate-like lock 50A (illustrated as a slidable flat tab) slidably mounted on two screws 51A. The lock 50A can be moved between a retracted release position (FIGS. 11-12) allowing the sections 24A,23A to be collapsed to a folded position (FIG. 11) and or unfolded and moved to an extended unlocked position (FIG. 12) and to an extended locked position (FIG. 13). In the extended locked position, the lock 50A engages the strip 47A with sufficient surface area and strength so that the support is stable (and so that it will not accidentally fold when shooting). It is noted that the lock 50A provides enough friction to hold itself in a selected position. The friction can be provided by the sliding action, or by a detent on the interfacing surfaces of the lock 50A and strip 48A, or can include a thumb nut on one of the screws 51A.

A method related to the present apparatus includes steps of providing a shoulder-to-gun support with a rear section shaped to engage a shooter's shoulder and a front section with bracket shaped to stably receive and support a grip of the handgun when clasped by hands of the shooter but with the bracket not being fixedly attached to the grip, supporting the handgun on the shoulder-to-gun support without fixed interconnection and while resting the support on a shooter's shoulder and while simultaneously clasping the grip and bracket with hands of the shooter, and shooting the handgun during the step of supporting.

It is to be understood that variations and modifications can be made on the aforementioned structure without departing from the concepts of the present invention, and further it is to be understood that such concepts are intended to be covered by the following claims unless these claims by their language expressly state otherwise.

The embodiments of the invention in which an exclusive property or privilege is claimed are defined as follows:

1. A handgun shoulder-supported platform for stably supporting a handgun to a shooter's shoulder when shooting the handgun, comprising:

a shoulder-to-gun support made of at least one elongated strip of metal of a first constant cross section with a rear section shaped to engage the shooter's shoulder and having a front section with a forwardly-extending first tab; and a grip-engaging bracket with a rearwardly-extending second tab engaging the first tab of the front section the first and second tabs each having a same cross section as the first constant cross section;

one of the support and bracket including a tube forming a socket shaped to receive the first and second tabs and hold them in an abutting juxtaposed position;

the bracket including an upwardly-open pocket-forming cup-shaped member shaped to matably releasably engage a grip of the handgun while the shooter's hand simultaneously holds both the bracket and the grip in the bracket.

2. The platform in claim 1, wherein the at least one elongated strip includes a single continuous strip forming the front and rear sections.

3. The platform in claim 1, wherein the at least one elongated strip includes a first strip forming the front section and a rear strip forming the rear section, the first and second strips including adjacent end flanges pivoted together so that the support is foldable to a collapsed storage position and unfoldable to an extended use position.

4. The platform in claim 1, wherein the support and bracket include connecting structure forming a fastenerless releasable connection.

5. The platform in claim 1, wherein the support and bracket include a tab and mating socket forming a frictional bayonet-simulating connection.

6. The platform of claim 1, wherein the cup-shaped member includes a bottom wall, side walls, and rear wall that define a cup-shape that is vertically open and shaped to engage and stably support a grip of the handgun without the use of mechanical fasteners, the side walls extending above the rear wall to define an opening above the rear wall that non-inteferferingly exposes a grip-supported pam safety on the handgun, the bottom wall including a slot to non-interferingly receive a downwardly-extending loop on the handgun's grip.

* * * * *